US005564372A

United States Patent [19]

Llewellyn

[11] Patent Number: 5,564,372

[45] Date of Patent: Oct. 15, 1996

[54] SPLIT WABBLER DESIGN FOR AXIAL-PISTON ENGINES

[76] Inventor: Dafydd J. Llewellyn, MS 544, Clifton, State of Queensland, Australia

[21] Appl. No.: 478,550

[22] Filed: Jun. 7, 1995

[51] Int. Cl.[6] ..... F01L 11/00; F02B 57/04

[52] U.S. Cl. ..... 123/56.3

[58] Field of Search ..... 123/56.3, 56.4, 123/56.6

[56] References Cited

U.S. PATENT DOCUMENTS

| | | | |
|---|---|---|---|
| 1,844,386 | 2/1932 | Harris et al. | 123/56.4 |
| 2,150,162 | 3/1939 | Hall | 123/56.4 |
| 2,304,054 | 12/1942 | Oldfield | 123/56.4 |
| 2,379,119 | 6/1945 | Tucker | 123/56.6 |
| 2,513,083 | 6/1950 | Eckert | 123/56.6 |
| 2,551,025 | 5/1951 | Lindeman | 123/56.3 |
| 2,957,462 | 10/1960 | Clark | 123/56.6 |
| 3,654,906 | 4/1972 | Airas | 123/56.4 |
| 5,437,251 | 8/1995 | Anglim et al. | 123/56.3 |

FOREIGN PATENT DOCUMENTS

| | | | |
|---|---|---|---|
| 414076 | 6/1946 | Italy | 123/56.4 |
| 625854 | 9/1961 | Italy | 123/56.4 |

*Primary Examiner*—David A. Okonsky

*Attorney, Agent, or Firm*—Perman & Green

[57] ABSTRACT

In an axial-piston engine of the type known as a "wabbler" engine, in which the motion of the pistons is transferred to a straight main shaft by means of a non-rotating element (referred to as the "wabbler") which nutates as the shaft rotates and transfers the motion to the pistons via arms at its periphery, a design of the wabbler in which the wabbler is made in two or more parts so as to enclose a swashplate on the shaft, with thrust bearings between the wabbler and the swashplate (which latter is fixed to the shaft). The parts of the wabbler are rigidly connected together, so as to maximise the bending strength of the assembly in resisting the thrust loads from the pistons, and to facilitate the transfer of the loads to the bearing surfaces so as to avoid excessive localised loading of the bearings. To this end, the mating surfaces between the parts of the wabbler have features such as serrating or grooving which by interlocking action enhance the transfer of shear forces, such that the bending strength which would have existed had the wabbler been all in one piece is retained to the greatest possible degree.

In this design, the body of the wabbler essentially consists of a short "cylinder" with heavy annular end plates; the spacing-apart of these ends provides a superior means of reacting the cantilever bean loads from the arms and of distributing these loads over the bearing surfaces.

8 Claims, 2 Drawing Sheets

SPLIT WABBLER DESIGN FOR AXIAL-PISTON ENGINES

BACKGROUND OF THE INVENTION

This invention relates to improvements in the piston drive mechanism of a particular form of an axial-piston engine.

An axial-piston engine is one in which the cylinders are arranged to lie with their axis parallel to the main shaft, instead of normal to it as in an engine having a conventional form of crankshaft.

Axial-piston engines may be classified into two principle generic varieties:

a) Those in which high velocity sliding contact curs directly between the pistons or slippers attached to the pistons, and the main retaining element. Examples of this variety are the Michell Crankless and Dyna-Cam (Herrmann) engines.

b) Those in which a non-rotating element is interposed between the rotating element and the pistons. This non-rotating element is connected to the main shaft by bearings, and its motion can be described as nutation, a wabbling action, by means of which arms at its edge are able to drive the pistons to and fro in a linear motion. Known as wabbler engines, engines of this form nave been undergoing design and development since the early part of the twentieth century.

The wabbler, which is a mechanism for the reversible conversion of linear into rotational motion, may take several forms depending on the nature of the bearing arrangement between it and me main shaft. By the use of a "Z" form of shaft, it is possible to use widely spaced bearings, which can be of either ball or roller type. If a straight shaft is used, the bearing usually takes the form of a thrust bearing, often of the Michell type, between the wabbler and the shaft.

SUMMARY OF THE INVENTION

In one form of this invention there is proposed an axial-piston engine including a main shaft, a swash plate secured to the main shaft, pistons within cylinders, the axis of each of which is parallel to the longitudinal axis of the main shaft the pistons being located in a discribed arrangement with each axis the same distance as each of the other axis from the longitudinal axis of the main shaft, and these being distributed around the main shaft and a wabbler interengaging between the pistons and the swashplate wherein the wabbler includes a central aperture and at least two walls the inner ends of which define the central aperture, the first of the walls providing a first inner surface, the second of the walls defining a second inner surface, the said two inner surfaces being spaced apart to provide thereby a swashplate receiving space.

In preference the wabbler includes within its central aperture a plurality of slipper bearings positioned between the swash plate and a first and second inner surface.

In preference the wabbler is comprised of a main body which is comprised of two separable parts, a first separable pad providing a first side of the wabbler and one side defining one side of the central aperture and the second separable part providing a second side of the wabbler including an opposite facing side to the said first side of the central aperture.

In preference the wabbler includes outwardly extending arms each arm engaging a crosshead slider by means of a wristpin the said crosshead slider engaging a piston through a transverse bore in said piston within which the crosshead slider is adapted to move up and down and twist to and fro as the piston moves through its cycle and wherein the said first and second separable parts define each of the facing sides of the respective crosshead slider shape.

In preference the two separable parts include interengaging shapes adapted to assist in resisting relative shear stresses between two separable parts.

In preference the swashplate is secured to the shaft with its respective planar faces aligned so as to be inclined to the longitudinal axis of the main shaft.

In preference the two separable parts are held together by bolts.

BRIEF DESCRIPTION OF THE DRAWINGS

For a better understanding a preferred embodiment will now be described with reference to the attached drawings in which.

DESCRIPTION OF THE PREFERRED EMBODIMENT

Figure 1:
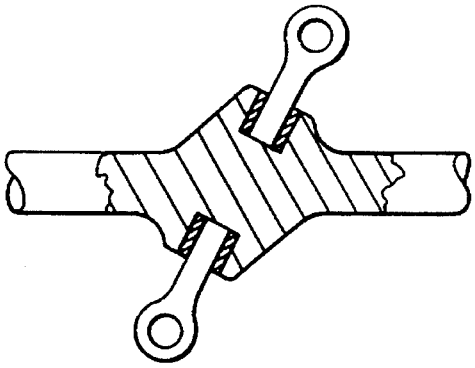
FIG. 1 is a cross sectional schematic view of a previous design.

This invention is for an improved form of wobbler design for use with a straight shaft. In a form hitherto used, the wobbler was designed to run in a slot provided for that purpose in a thickened part of the main shaft; where slipper bearings of the Michell type separated the wabbler from the main shaft. However, with this form of construction it was difficult to provide a wabbler with adequate thickness to give the bending strength necessary to resist fatigue of the wabbler under the fluctuating thrust loads from the pistons which act to bend the cantilever arms of the wabbler. This type of wabbler design, generally known as the Aimen design, is illustrated in FIG. 1 where 1 is the main shaft, 2 is the wabbler and 3 are the bearing slippers.

Figure 2:
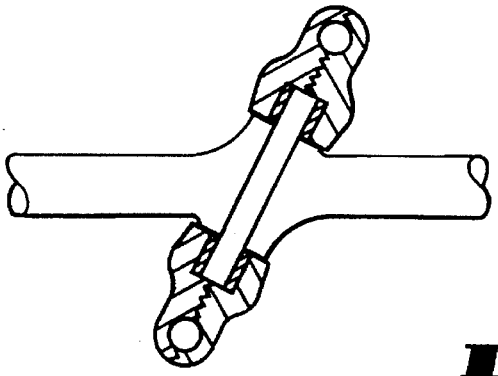
FIG. 2 is a schematic view showing the concept of the embodiment.

The present invention provides a form of construction in which the Almen design is turned inside out, with the wabbler constructed in two parts, and which are assembled around a swashplate on the shaft so as to enclose it. This design is illustrated in schematic outline in FIG. 2 where 4 is the main shaft, 5 is the swashplate, 6 is the wabbler, 7 is the parting plane between the two wabbler parts and 8 are the bearing slippers. In order that the necessary parting plane between the two parts of the wabbler shall not seriously reduce the bending strength of the arms, features are used at the interface of the two wabbler parts to enhance the strength of the assembled wabbler. One form of such a feature is the grooving or serrating of the mating surfaces to form interlocking serrations, which enhance the transfer of shear forces across the interface between the two parts of the wabbler.

The bases of the wabbler arms input the bending moments and shear forces into the body of the wabbler which can be considered to consist of a short cylinder having thick end walls, with a hole in the centre of each end wall through which the main shaft runs. The bending moment takes the form of a couple, the individual forces of which act as edge loads on the annular end walls of the cylindrical body of the wabbler; since these forces lie in the plane of the annulus, a maximum stiffness of strength is available to react them.

The shear force at the base of each arm goes into the cylindrical wall of the wabbler body, and is thence distributed around the edge of the annular ends, which in turn distribute it over the bearing surfaces.

The differential edge loads on the annular ends of me wabbler body arising from the cantilever bending of the arms, are in turn reacted over a large area by shear flows in the part of the cylindrical sides which are remote from the base of the arm which is underloaded at any particular time, and are themselves redistributed as loads on the bearing surfaces. Thus, a concentrated local loading on the bearing surfaces is avoided; by suitable thicknessing of the various parts of the wabbler body a desired distribution of load on the bearings can be achieved.

Figure 3:
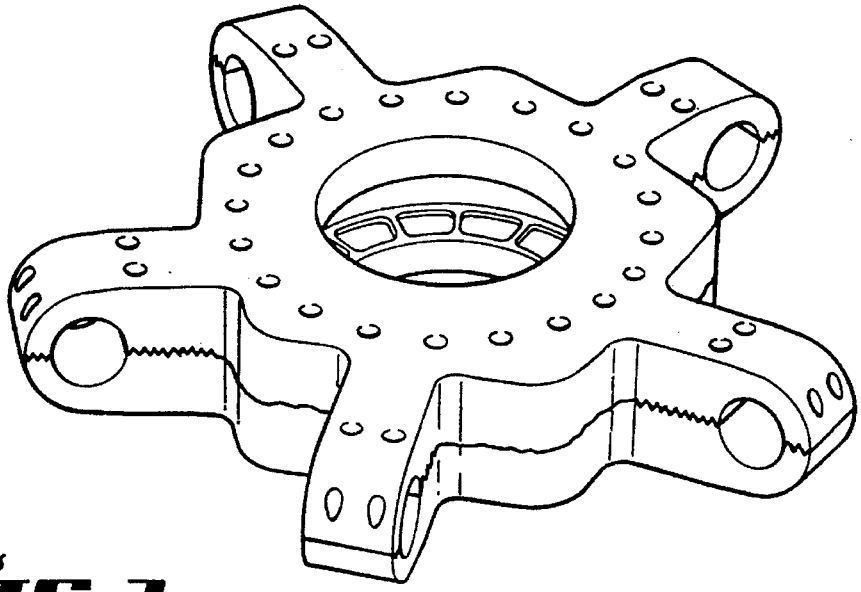
FIG. 3 is a perspective view of the embodiment.
Figure 5:
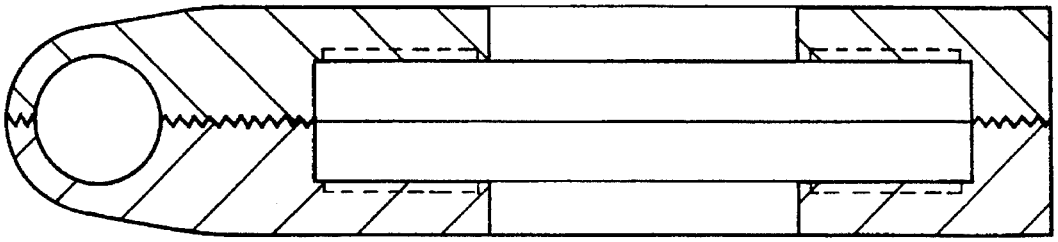
FIG. 5 is a cross sectional view along the lines A—A' of the wabbler as shown in FIG. 4.

FIG. 3 shows the assembled wabbler to be used in the engine design while FIG. 5 is a cross-sectional view of the assembled wabbler. The two separable wabbler parts are rigidly connected together at plane 7 and held there by bolts (not shown) which pass through holes 9. In this embodiment the wabbler includes a central aperture 10 and two walls 11 and 12 the inner ends of which define the central aperture 10, the first of the walls 11 providing a first inner surface 13, the second of the walls 12 defining a second inner surface 14, the said two inner surfaces 13 and 14 being spaced apart to provide thereby a swashplate receiving space 15. The wabbler also consists of outwardly extending arms 16 which engage crosshead sliders (not shown) in the cylindrical spaces 17 and fixed in relation to the wabbler by wristpins (not shown). The crosshead slider engages a piston through a transverse bore in said piston within which the crosshead slider moves up and down and twists to and fro as the piston moves through its cycle (this multi-directional movement also gives better lubricating conditions as compared to a normal wristpin). This division of the wabbler into two separable parts allows the wabbler to be assembled around the swashplate and also allows the arms 16 to be substantially thicker than the old designs thereby better suited to transfer the piston thrust forces onto the bearing surfaces 18 between the wabbler and the swashplate.

Figure 4:
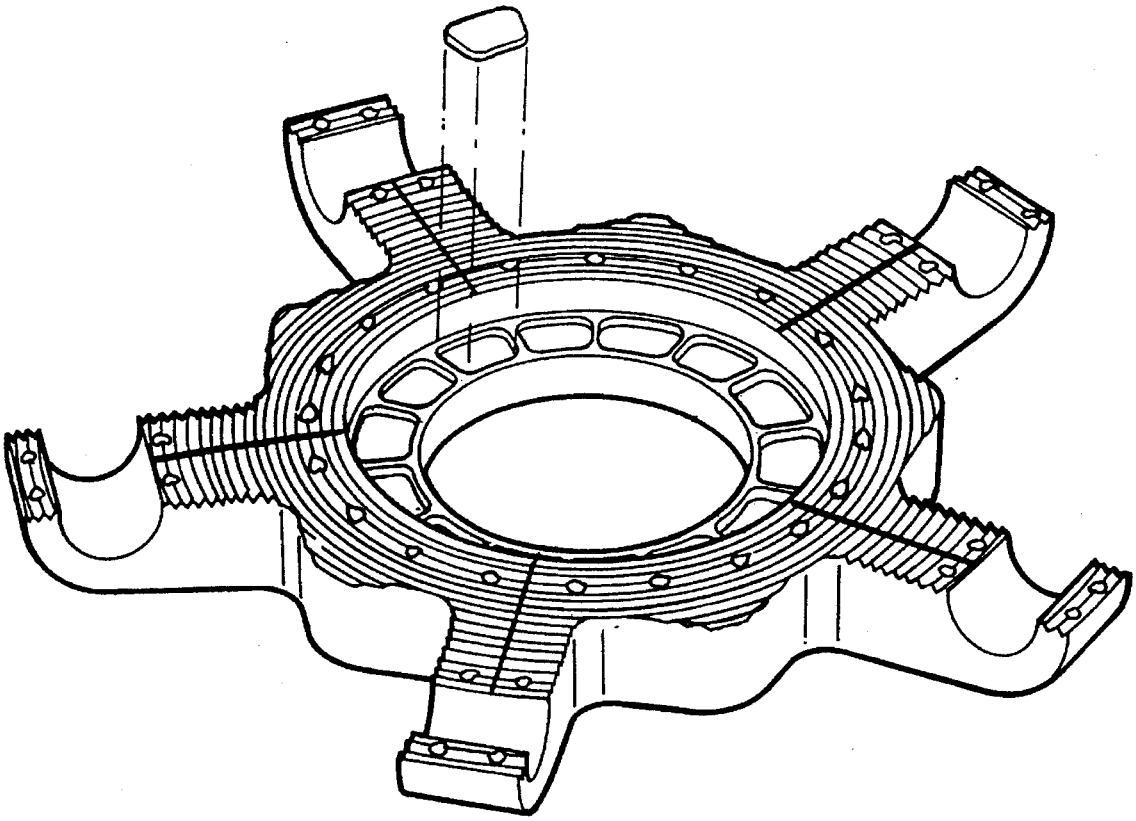
FIG. 4 is a perspective view of one part of the wabbler showing the inner face with a slipper bearing exploded from a nesting position.

FIG. 4 shows one of the two parts of the wabbler showing the parting plane 7 which is grooved so as to enhance the transfer of shear forces across the interface between the two wabbler parts. 8 is the bearing slipper which separates the wabbler from the swashplate. In addition the wabbler has oil channels 19 which facilitate in the lubrication of the wabbler mechanism.

In the above drawings, five arms have been indicated. This type of wabbler is not however limited to that number only.

We claim:

1. An axial-piston engine including a main shaft, a swashplate secured to the main shaft, pistons within cylinders, the axis of each of which is parallel to the longitudinal axis of the main shaft, the pistons being located in a distributed arrangement with each axis the same distance as each of the other axes from the longitudinal axis of the main shaft, and these being distributed around the main shaft, and a wabbler interengaging between the pistons and the swashplate wherein the wabbler includes a central aperture and at least two walls the inner ends of which define the central aperture, the walls rigidly connected to one another along opposed connecting surfaces with each connecting surface having elements interengaging with one another to enhance the transfer of shear forces, said first and second walls further providing a first inner surface, the second of the walls defining a second inner surface, the two inner surfaces being spaced apart from said plane to provide thereby a swashplate receiving space.

2. An axial-piston engine as in claim 1 further characterised in that the wabbler is comprised of a main body which is comprised of two separable parts, a first separable part providing a first side of the wabbler and one side defining one side of the central aperture and the second separable part providing a second side of the wabbler including an opposite facing side to the said first side of the central aperture.

3. An axial-piston engine as in claim 2 further characterised in that the wabbler includes outwardly extending arms each arm engaging a crosshead slider by means of a wristpin the said crosshead slider engaging a piston through a transverse bore in said piston within which the crosshead slider is adapted to move up and down and twist to and fro as the piston moves through its cycle and wherein the said first and second separable parts define each of the facing sides of the respective crosshead slider shape.

4. An axial-piston engine as in claim 1, further characterised in that the swashplate is secured to the shaft with its respective planar faces aligned so as to be inclined to the longitudinal axis of the main shaft.

5. A wabbler for an axial piston engine as in claim 1 wherein the wabbler is comprised of a main body which is comprised of two separable parts, a first separable part providing a first side of the wabbler and one side defining one side of the central aperture and the second separable part providing a second side of the wabbler including an opposite facing side to the said first side of the central aperture.

6. A wabbler for an axial-piston engine as in the immediately preceding claim 5 in which the two separable parts are held together by bolts.

7. An axial-piston engine as in claim 1 further characterised in that the wabbler includes within its central aperture a plurality of slipper bearings positioned between the swash plate and first and second inner surfaces.

8. An axial-piston engine including a main shaft, a swashplate secured to the main shaft, pistons within cylinders, the axis of each of which is parallel to the longitudinal axis of the main shaft, the pistons being located in a distributed arrangement with each axis the same distance as each of the other axes from the longitudinal axis of the main shaft, and these being distributed around the main shaft, and a wabbler interengaging between the pistons and the swashplate wherein the wabbler includes a central aperture and at least two walls the inner ends of which define the central aperture, the walls rigidly connected to one another along opposed connecting surfaces with each connecting surface having elements interengaging with one another to enhance the transfer of shear forces, said first and second walls further providing a first inner surface and a second inner surface, said first and second inner surfaces being spaced apart from said plane to provide thereby a space within said central aperture for receiving said swashplate therewithin; and a plurality of slipper bearings positioned between the swashplate and the first and second inner surfaces.

* * * * *